US009108246B2

(12) United States Patent
Maeda et al.

(10) Patent No.: US 9,108,246 B2
(45) Date of Patent: Aug. 18, 2015

(54) METHOD FOR MIXING RAW MATERIAL POWDER FOR POWDER METALLURGY AND METHOD FOR PRODUCING RAW MATERIAL POWDER FOR POWDER METALLURGY

(75) Inventors: Yoshiaki Maeda, Izumi-gun (JP); Kiyoshi Makino, Chiba (JP); Kotaro Okawa, Chiba (JP); Ichio Sakurada, Ichihara (JP); Kuniaki Ogura, Mobara (JP); Yukiko Ozaki, Chiba (JP)

(73) Assignee: JFE STEEL CORPORATION, Tokyo (JP)

( * ) Notice: Subject to any disclaimer, the term of this patent is extended or adjusted under 35 U.S.C. 154(b) by 1397 days.

(21) Appl. No.: 12/452,857

(22) PCT Filed: Aug. 13, 2008

(86) PCT No.: PCT/JP2008/064762

§ 371 (c)(1),
(2), (4) Date: Apr. 16, 2010

(87) PCT Pub. No.: WO2009/025274

PCT Pub. Date: Feb. 26, 2009

(65) Prior Publication Data

US 2010/0284239 A1 Nov. 11, 2010

(30) Foreign Application Priority Data

Aug. 20, 2007 (JP) ..... 2007-213227

(51) Int. Cl.
*B01F 15/06* (2006.01)
*B22F 1/00* (2006.01)
*C22C 33/02* (2006.01)

(52) U.S. Cl.
CPC ..... *B22F 1/0077* (2013.01); *B22F 1/0085* (2013.01); *C22C 33/0264* (2013.01)

(58) Field of Classification Search
CPC ..... B22F 1/0077
USPC ..... 75/710
See application file for complete search history.

(56) References Cited

U.S. PATENT DOCUMENTS

| | | | | |
|---|---|---|---|---|
| 4,946,499 | A | 8/1990 | Sakuranda et al. | |
| 5,135,566 | A | 8/1992 | Sakuranda et al. | |
| 2001/0028859 | A1 * | 10/2001 | Ozaki et al. | 419/35 |

FOREIGN PATENT DOCUMENTS

| | | | |
|---|---|---|---|
| EP | 0 853 994 | A1 | 7/1998 |
| EP | 0 861 698 | A2 | 9/1998 |
| EP | 0 913 220 | A1 | 5/1999 |
| EP | 1 364 731 | A2 | 11/2003 |
| JP | A-01-165701 | | 6/1989 |
| JP | A-02-047201 | | 2/1990 |
| JP | A-03-162502 | | 7/1991 |

OTHER PUBLICATIONS

Written Opinion of the International Searching Authority issued in International Application No. PCT/JP2008/064762 on Oct. 14, 2008 (with translation).
International Search Report issued in International Application No. PCT/JP2008/064762 on Oct. 14, 2008.
May 3, 2013 Extended European Search Report issued in European Application No. 08792542.6.

* cited by examiner

*Primary Examiner* — Jessee Roe
*Assistant Examiner* — Christopher Kessler
(74) *Attorney, Agent, or Firm* — Oliff PLC

(57) ABSTRACT

The present invention provides a method for mixing a raw material powder for powder metallurgy that allows efficient mixing at a low cost with a simple measure and easy adjustment of the apparent density by performing first agitation mixing in which a powder mixture obtained by adding, to an iron powder, one or two or more members selected from lubricant powders, free-machining agent powders, and lubricant powders for sliding surface, an alloying powder, and a binding agent is agitated while increasing the temperature to a temperature $T_K$ equal to or higher than the melting point $T_M$ of the binding agent, the resultant is agitated while maintaining the temperature $T_K$, and the resultant is further agitated while reducing the temperature from the temperature $T_K$, and performing second agitation mixing in which the obtained powder mixture is agitated while cooling.

18 Claims, 1 Drawing Sheet

METHOD FOR MIXING RAW MATERIAL POWDER FOR POWDER METALLURGY AND METHOD FOR PRODUCING RAW MATERIAL POWDER FOR POWDER METALLURGY

TECHNICAL FIELD

The present invention relates to a method for mixing a raw material powder for use in powder metallurgy technology.

The present invention also relates to a method for producing a raw material powder for powder metallurgy using the mixing method.

BACKGROUND ART

The raw material powder for use in powder metallurgy technology (hereinafter referred to as a raw material powder for powder metallurgy) is produced by mixing an iron powder as a basic component, a metal powder containing an alloy component (hereinafter referred to as an alloying powder), and a binding agent for fixing the alloying powder (or at least some of them) to the surface of the iron powder (hereinafter referred to as a binding agent). Moreover, a raw material powder for powder metallurgy containing, as required, one or two or more members selected from lubricant powders, flow enhancing agents, free-machining agent powders, and lubricant powders for sliding surface is also used.

In the raw material powder for powder metallurgy, it is required that the alloying powder is fixed to the surface of the iron powder through the binding agent and the lubricant powder, the flow enhancing agent, the free-machining agent powder, the lubricant powder for sliding surface, and the like, which are added as required, are uniformly mixed. Then, various mixing methods have been examined.

For example, Japanese Unexamined Patent Application Publication No. 2-47201 (Patent Document 1) discloses a technology for adding an alloying powder, a free-machining agent powder, and a lubricant powder to an iron powder and performing first mixing, adding a binding agent and performing second mixing while increasing the temperature, and performing third mixing while cooling.

DISCLOSURE OF INVENTION

Problems to be Solved by the Invention

However, since the first to third mixing processes are performed by one mixing device according to the technology disclosed in Patent Document 1, the mixing device is exclusively used over a long period of time until the raw material powder for powder metallurgy is obtained by charging raw material powders, such as the iron powder or the alloying powder, and mixing.

Furthermore, according to the technology disclosed in Patent Document 1, it is difficult to adjust the apparent density of the raw material powder for powder metallurgy. More specifically, in order to obtain a raw material powder for powder metallurgy having a high apparent density, it is required to grind the raw material powders, such as the iron powder or the alloying powder by prolonging the mixing time to thereby obtain round shaped particles, which reduces the productivity. In contrast, in order to obtain a raw material powder for powder metallurgy having a low apparent density, the mixing time needs to be shortened, possibly resulting in segregation of the raw material powder.

It is an object of the present invention to provide a method for mixing a raw material powder for powder metallurgy that allows efficient mixing at a low cost with a simple measure and easy adjustment of the apparent density. It is another object of the present invention to provide a method for producing a raw material powder for powder metallurgy having excellent uniformity and productivity irrespective of the apparent density.

Means for Solving the Problems

The present invention is a method for mixing a raw material powder for powder metallurgy, including: performing first agitation mixing in which a powder mixture obtained by adding, to an iron powder, an alloying powder, a binding agent, and one or two or more members selected from lubricant powders, free-machining agent powders, and lubricant powders for sliding surface, is agitated while increasing the temperature to a temperature $T_K$ equal to or higher than the melting point (hereinafter referred to as $T_M$) of the binding agent, the resultant is agitated while maintaining the temperature $T_K$, and the resultant is further agitated while reducing the temperature from the temperature $T_K$; and performing second agitation mixing in which the obtained powder mixture is agitated while further cooling.

In the mixing method of the invention, the first agitation mixing process is preferably performed using a high-speed agitating mixer (e.g., Henschel mixer). The second agitation mixing process is preferably performed using a high-speed agitating mixer or a conical screw mixer (e.g. Nauta mixer). More specifically, although a first agitating mixer for performing the first agitation mixing process and a second agitating mixer for performing the second agitation mixing process are separately provided, the mixer type may be the same or different.

In the first agitation mixing, it is preferable that gentle agitation is performed in a process for increasing the temperature to the temperature $T_K$ and in a process for reducing the temperature from the temperature $T_K$ and strong agitation be performed in a process for maintaining the temperature $T_K$. Moreover, it is preferable that switching from the first agitation mixing to the second agitation mixing is conducted so that the duration of the first agitation mixing and the duration of the second agitation mixing are equal to each other.

Also, the present invention is a method for producing a raw material powder for powder metallurgy, including mixing the iron powder, the alloying powder, the binding agent, and one or two or more members selected from the lubricant powders, the free-machining agent powders, and the lubricant powders for sliding surface in accordance with the aforementioned mixing method.

REFERENCE NUMERALS

Figure 1:
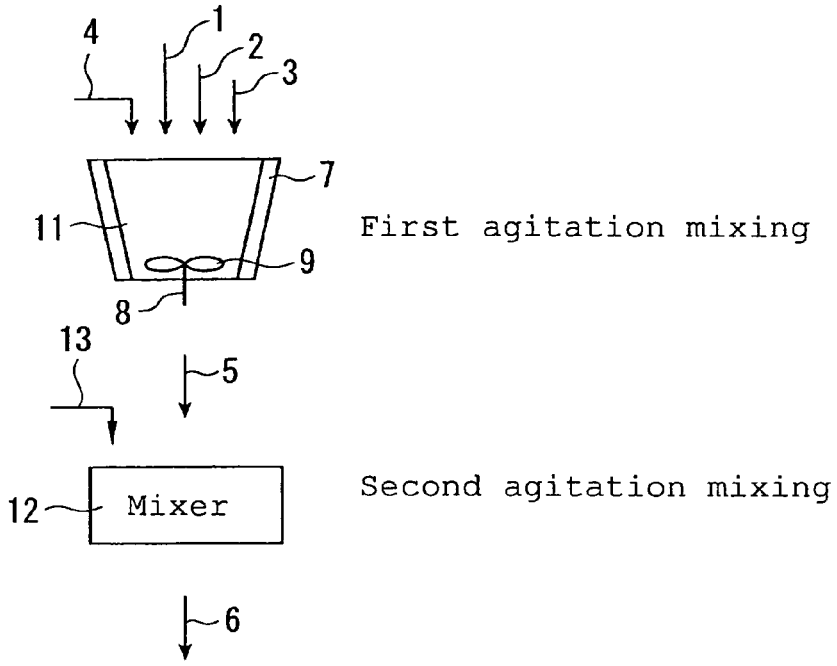
FIG. 1 is a flow chart illustrating a procedure of the invention.

1 Iron powder
2 Alloying powder
3 Binding agent
4 Additive powder

5 Powder mixture
6 Raw material powder for powder metallurgy
7 Double layered structure
8 Rotating shaft
9 Rotating impeller
11 First agitating mixer
12 Second agitating mixer
$T_K$ Maintained temperature in first agitation mixing
$T_M$ Melting point of binding agent
$t_1$ Duration of first agitation mixing
$t_2$ Duration of second agitation mixing
$t_3$ Switching time
$t_{TOTAL}$ Total time of one cycle

BEST MODES FOR CARRYING OUT THE INVENTION

FIG. 1 is a flow chart illustrating a procedure of the invention using a flow chart including the cross sectional view of a mixer. As illustrated in FIG. 1, in the invention, mixing is performed by separately performing first agitation mixing (top) and second agitation mixing (bottom).

(First Agitation Mixing)

First, the first agitation mixing will be described.

As illustrated in FIG. 1, an iron powder 1, a metal powder 2 (i.e., alloying powder) containing an alloy component, and a binder 3 (i.e., binding agent) for fixing the alloying powder 2 to the surface of the iron powder 1 are charged in a first agitating mixer 11. Furthermore, one or two or more members selected from lubricant powders, free-machining agent powders, and lubricant powders for sliding surface is/are charged in the first agitating mixer 11. Here, the lubricant powder, the free-machining agent powder, and the lubricant powder for sliding surface are collectively referred to as an additive powder, which is designated by a reference number 4 in FIG. 1.

Both the iron powder and the additive powder can be selected from known substances according to the application for use. For example, pure iron powders or alloy steel powders (including diffusion alloyed steel powder and the like) are usable as the iron powder. Examples of other raw materials include the following substances but are not limited thereto.

Alloy steel powder: Graphite powder, Ni powder, Cu powder, Mo powder, W powder, etc.

Binding agent: Amide-based waxes, polyamide, amides and metal soap (co-melted for use), etc.

Lubricant powder: Metal soap (which does not melt in the first mixing), amides (which do not melt in the first mixing), etc.

Free-machining agent powder: MnS, $CaF_2$, etc.

Lubricant powder for sliding surface: $MoS_2$, etc.

The melting point $T_M$ of the binding agent is preferably adjusted to about 0 to 150° C.

The first agitating mixer 11 is not limited to a specific type, and known devices are used. However, according to the study of the present inventors, a high-speed agitating mixer is preferable, and particularly a Henschel mixer is preferable.

As illustrated in the top of FIG. 1, the high-speed agitating mixer mixes the powders in the first agitating mixer 11 by rotating the rotating impeller 9 around the rotating shaft 8. Since the mixer has high agitating ability, the iron powder 1, the alloying powder 2, the binding agent 3, and the additive powder 4 can be easily ground to form round-shaped particles. Furthermore, by controlling the agitation time by the rotating impeller 9 or the rotational speed of the rotating impeller 9 to change the progress of grinding, thereby adjusting the apparent density of the powders in the first agitating mixer 11.

The first agitating mixer 11 is provided with a heating member to agitate the powders in the first agitating mixer 11 while increasing the temperature. As the heating member, known heating technologies are used. In the first agitation mixing, not only the heating member but a cooling member described later is required. Therefore, it is preferable to select a technology that can obtain a heating function and a cooling function with a simple measure.

For example, when an electric heater is used, the temperature of the powders in the first agitating mixer 11 can be increased. However, since the electric heater is not provided with a cooling function, a cooling member needs to separately dispose (e.g. water-cooling), which complicates the structure of the first agitating mixer 11.

According to the study of the present inventors, it is preferable to form the circumference of the first agitating mixer 11 into a double walled structure as illustrated in FIG. 1. When formed into a double walled structure, the temperature of the powders in the first agitating mixer 11 can be increased by circulating high-temperature steam or oil through a double layered structure 7. For cooling, low-temperature water or oil may be simply circulated. In other words, by forming the circumference of the first agitating mixer 11 into the double walled structure, the temperature of the powders in the first agitating mixer 11 can be increased and reduced with a simple measure. Other temperature increasing measures and/or temperature reducing measures may be used in combination.

Thus, the powders in the first agitating mixer 11 are agitated while increasing the temperature. Then, the temperature is increased until the temperature reaches the temperature $T_K$ equal to or higher than the melting point $T_M$ of the binding agent 3, and the powders are further agitated while maintaining the temperature $T_K$. By maintaining the temperature $T_K$, the binding agent 3 melts and, by agitating, the binding agent 3 in a molten state is applied to the surface of the iron powder 1, whereby the alloying powder 2 and the additive powder 4 further adhere to the iron powder. The time for increasing the temperature is not particularly limited, and is preferably adjusted to about 5 to 40 minutes from the viewpoint of productivity and economical efficiency.

Subsequently, the powders in the agitating mixer 11 are agitated while cooling. When the temperature decrease to a temperature equal to or lower than the melting point $T_M$, the binding agent 3 solidifies to thereby fix the alloying powder 2 and the additive powder 4 to the surface of the iron powder 1. The cooling member is as previously described above together with the heating member. The time for cooling is not particularly limited, and is preferably adjusted to 60 minutes or less from the viewpoint of productivity and economical efficiency.

The first agitation mixing is ceased in the cooling process, and the powders in the first agitating mixer 11 are discharged.

(Second Agitation Mixing)

A mixture 5 thus obtained (hereinafter referred to as a powder mixture) of the iron powder 1, the alloying powder 2, the binding agent 3, and the additive powder 4, is charged in a second agitating mixer 12. Furthermore, one or two or more member(s) (second additive powder 13) selected from lubricant powders, flow enhancing agents, free-machining agent powders, and lubricant powders for sliding surface is/are charged, as required, in a second agitating mixer 12. As the flow enhancing agents, lubricant powders, and free-machining agent powders, known substances can be preferably used. As the flow enhancing agents, nanosized oxide powders such as fumed silica, carbon black, etc., are mentioned. As the lubricant powders and the free-machining agent powders, the substances mentioned as the additive powder in the first agitation mixing above can be utilized. However, the lubricant powders and the free-machining agent powders do not need to be the same as those selected in the first agitation mixing.

Next, the second agitation mixing will be described.

The second agitating mixer 12 is not limited to a specific type (therefore, the details are not illustrated in the drawings), and known devices are used. However, according to the study of the present inventors, a high-speed agitating mixer or a conical screw mixer is preferable, and particularly a Henschel mixer or a Nauta mixer is preferable.

The second agitating mixer 12 is provided with a cooling member, and agitates the powder mixture 5 in the second agitating mixer 12 while cooling. Known cooling technologies are used as the cooling member. According to the study of the present inventors, it is preferable to form the circumference of the second agitating mixer 12 into a double walled structure similarly as in the first agitating mixer 11 illustrated in FIG. 1. When formed into a double walled structure, the powders in the second agitating mixer 12 can be cooled by circulating low-temperature water or oil.

The powder mixture 5 in the second agitating mixer 12 is cooled to room temperature while agitating (sufficient when the temperature decreases to 80° C. or lower), and discharged from the second agitating mixer 12, thereby obtaining a raw material powder for powder metallurgy 6 having a given apparent density.

Figure 2:
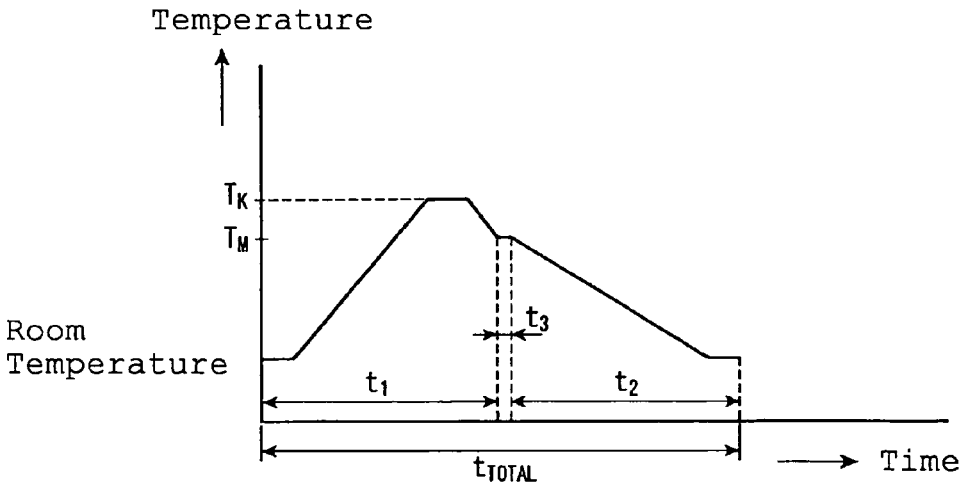
FIG. 2 is a graph illustrating the relationship between the time and the temperature in an agitation mixing process.

The relationship between the time until the iron-powder 1, the alloying powder 2, the binding agent 3, and the additive powder 4 are charged in the first agitating mixer 11, and then the raw material powder for powder metallurgy 6 is discharged from the second agitating mixer 12 (hereinafter referred to as one cycle) as described above and the temperatures during the cycle is illustrated in FIG. 2. In FIG. 2, $t_1$ designates a duration of the first agitation mixing, $t_2$ designates a duration of the second agitation mixing, and $t_3$ designates a duration in which the powder mixture 5 is discharged from the first agitating mixer 11, and charging the same in the second agitating mixer 12 (hereinafter referred to a switching time).

(Adjustment of Each Agitation Mixing)

In the invention, the timing (i.e., time allocation of the first agitation mixing and the second agitation mixing) when the switching from the first agitation mixing to the second agitation mixing is conducted is not particularly limited. The time allocation is suitably determined according to properties (i.e., an apparent density, a particle size, etc.) required for the raw material powder for powder metallurgy 6, the facility specification of the first agitating mixer 11 and the second agitating mixer 12, etc. Depending on the timing when the switching from the first agitation mixing to the second agitation mixing is conducted, temperatures may decrease to be equal to or lower than the melting point $T_M$ during the second agitation mixing. Also in such a case, the raw material powder for powder metallurgy 6 can be mixed without any trouble.

It is preferable that the duration $t_1$ of the first agitation mixing and the duration $t_2$ of the second agitation mixing be equal to each other (i.e., $t_1=t_2$). The total time $t_{TOTAL}$ of one cycle is the total of the duration $t_1$ of the first agitation mixing, the duration $t_2$ of the second agitation mixing, and the switching time $t_3$ from the first agitation mixing to the second agitation mixing (i.e., $t_{TOTAL}=t_1+t_2+t_3$). Thus, by adjusting the $t_1$ and $t_2$ to be $t_1=t_2$, the interval in which the raw material powder for powder metallurgy 6 is discharged from the second agitating mixer 12 is shortened to about $\frac{1}{2}t_{TOTAL}$. As a result, the raw material powder for powder metallurgy 6 is discharged twice during the total time $t_{TOTAL}$ of one cycle. It is a matter of course that even when $t_1$ and $t_2$ are not strictly adjusted to be $t_1=t_2$, sufficient effects are obtained when $t_2$ is about $t_1 \pm 20\%$. Preferably, $t_2$ is about $t_1 \pm 10\%$.

It is preferable, in the first agitation mixing, that the agitation be performed relatively strongly (hereinafter referred to as strong agitation) while maintaining the temperature $T_K$ and the agitation be performed relatively gently (hereinafter referred to as gentle agitation) in the process for increasing the temperature to the temperature $T_K$ and in the process for reducing the temperature from the temperature $T_K$. Since the binding agent 3 melts in a state where the temperature $T_K$ is maintained, the alloying powder 2 and the additive powder 4 can be uniformly adhered to the surface of the iron powder 1 by performing strong agitation. By performing gentle agitation in the process for increasing the temperature to the temperature $T_K$ and the process for reducing the temperature from the temperature $T_K$, excessive grinding of the iron powder 1, the alloying powder 2, and the additive powder 4 can be prevented. By the method, particularly a raw material powder for powder metallurgy that has a low apparent density and is uniformly mixed can be easily mixed and produced. In order to increase the apparent density of the raw material powder for powder metallurgy, strong agitation can be conversely performed at least partially in the agitation during an increase and/or a reduction in the temperature.

Here, in the case of strong agitation, when a 2 L Henschel mixer is taken as an example (blade diameter of 180 mm), agitation equivalent to the rotation number of about 500 rpm or more is preferable. In gentle agitation, more gentle agitation than the agitation equivalent to the rotation number of about 500 rpm or more is preferable.

As a measure for increasing the apparent density of the raw material powder for powder metallurgy, a measure for increasing the $t_{TOTAL}$ is acceptable in addition to the above. Here, since the interval in which the raw material powder for powder metallurgy 6 is discharged from the second agitating mixer 12 is shortened up to $\frac{1}{2}t_{TOTAL}$ in the invention, effects of a reduction in productivity can be lessened. Moreover, the time of strong agitation at the temperature $T_K$ may be intensively increased.

The first agitating mixer and the second agitating mixer are freely combined, and the combination thereof can be changed according to the application. For example, a device suitable for strong agitation (for high apparent densities) and a device suitable for gentle agitation (for low apparent densities) are prepared for the second agitating mixer, and may be selected when switching from the first agitation mixing.

Moreover, a relatively inexpensive device may be adopted as the second agitating mixer, and one or more second agitating mixers per the first agitating mixer may be disposed. For example, when two second agitating mixers are disposed in series per the first agitating mixer, the interval in which the raw material powder for powder metallurgy 6 is discharged from the second agitating mixer 12 is shortened to about $\frac{1}{3}t_{TOTAL}$ by adjusting $t_1$ and $t_2$ to be $t_2=t_1\times 2$ (about ±20%, preferably about ±10%). The productivity can be optimized also by using a first agitating mixer and a second agitating mixer that are different in the capacity.

As described above, when the invention is applied, the raw material powder for powder metallurgy can be efficiently mixed at a low cost with a simple measure and the apparent density of the raw material powder for powder metallurgy can also be adjusted.

EXAMPLES

Example 1

As illustrated in FIG. 1, the iron powder 1 (atomized pure iron powder), the alloying powder 2 (0.8% of graphite powder and 2.0% of atomized copper powder: % by mass relative to the whole raw material powder for powder metallurgy, the same applies in the following description), and the binding agent 3 (oleic acid: 0.1%) were charged in the first agitating mixer 11, and further a lubricant powder (zinc stearate: 0.4%) as the additive powder 4 was charged in the first agitating mixer 11 (Total: about 1.8 t). As the first agitating mixer 11, a Henschel mixer (capacity: 1,000 L, Maximum rotational speed of 150 rpm) was used, and the circumference thereof was formed into a double walled structure. The iron powder 1, the alloying powder 2, the binding agent 3, and the additive powder 4 in the first agitating mixer 11 were agitated and mixed while heating by circulating steam (water vapor) through the double layered structure 7.

When the temperature reached a given maintained temperature $T_K$ (Duration of experience: 20 minutes), agitation was further performed while maintaining the temperature $T_K$ for 5 minutes. The maintained temperature $T_K$ (about 140° C.) is a temperature higher than the melting point $T_M$ (about 110 to 130° C.) of the binding agent 3. The rotational speed (130 rpm) of the rotating impeller 9 when agitated at the maintained temperature $T_K$ was increased to be higher than the rotational speed (100 rpm) in the temperature increasing process.

Subsequently, the iron powder 1, the alloying powder 2, the binding agent 3, and the additive powder 4 in the first agitating mixer 11 were agitated while cooling by circulating cold water through the double layered structure 7. In the cooling process, the rotational speed of the rotating impeller 9 was reduced to be lower (80 rpm) than that of the agitation at the maintained temperature $T_K$.

The first agitation mixing was ceased in the cooling process (5 minutes later). Then, the obtained powder mixture 5 was discharged from the first agitating mixer 11, and then charged in the second agitating mixer 12. Furthermore, lubricant powder (zinc stearate: 0.4%) as the additive powder was charged in the second agitating mixer 12. As the second agitating mixer 12, a Nauta mixer (capacity: 1000 L, Maximum rotational speeds: rotation of 60 rpm and revolution of 2 rpm) was used, and the circumference thereof was formed into a double walled structure. The powder mixture 5 in the second agitating mixer 12 was agitated (rotation of 60 rpm and revolution of 2 rpm) and mixed while cooling by circulating cold water through the double layered structure. The duration $t_1$ of the first agitation mixing and the duration $t_2$ of the second agitation mixing were adjusted to be $t_1=t_2$.

Thus, when the temperature decreased to room temperature, the resultant was discharged from the second agitating mixer 12. The apparent density of the obtained raw material powder for powder metallurgy 6 satisfied a predetermined target range (2.8 to 3.6 Mg/m$^3$).

Example 2

Raw material powders for powder metallurgy were mixed and produced under the respective conditions illustrated in Table 1. The conditions (e.g. proportion of each processing time of the process for increasing the temperature, the process for maintaining the temperature $T_K$, and the process for cooling) other than the conditions illustrated in Table 1 were the same as in Example 1. In the invention, the apparent density in a wide range can be achieved while suppressing a reduction in productivity. As is understood from the comparison between Experiments Nos. 2-1 and 2-3 and the comparison between Experiments Nos. 2-2 and 2-3, the apparent density can be adjusted or the same raw material powder can be mixed at a higher speed by adjusting the agitation force of the mixers in the first agitation mixing and the second agitation mixing without changing other operation conditions (thus, without applying a load to the whole process).

As a Comparative Example, the whole process of $t_1$ and $t_2$ was performed using one (and the same) Henschel mixer. First, mixing was performed under the conditions of Gentle agitation during increasing the temperature, Strong agitation during maintaining the temperature $T_K$, and Strong agitation during cooling so that the apparent density was "low". Then, the total processing time was 20 minutes, and thus time sufficient for mixing was not secured, resulting in insufficient mixing of the raw materials. More specifically, when samples were randomly extracted from the obtained raw material powder for powder metallurgy, the concentration of graphite powder varied by ±20% relative to the average content (in the case of the Examples of invention, ±10% or lower). When the apparent density was "medium" or higher, the uniformity was secured, but the interval in which the raw material powder for powder metallurgy was discharged was $t_1+t_2$, and thus the productivity was not secured.

TABLE 1

| | First agitation mixing | | | | | Second agitation mixing | | | |
|---|---|---|---|---|---|---|---|---|---|
| Experiment No. | Mixer | Agitation during increasing temperature* | Agitation during maintaining $T_K$* | Agitation during cooling* | $t_1$ (minute) | Mixer | Agitation during cooling* | $t_2$ (minute) | Apparent density** |
| 2-1 | Henschel mixer | Gentle agitation 1 | Strong agitation | Gentle agitation 1 | 20 | Nauta mixer | Gentle agitation 2 | 20 | Low |
| 2-2 | Henschel mixer | Gentle agitation 1 | Strong agitation | Gentle agitation 1 | 40 | Nauta mixer | Gentle agitation 2 | 40 | Medium |
| 2-3 | Henschel mixer | Gentle agitation 1 | Strong agitation | Gentle agitation 1 | 20 | Henschel mixer | Strong agitation | 20 | Medium |
| 2-4 | Henschel mixer | Strong agitation | Strong agitation | Strong agitation | 100 | Henschel mixer | Strong agitation | 100 | High |

*Strong agitation: in Henschel mixer at 130 to 150 rpm, Gentle agitation 1: in Henschel mixer at 80 to less than 130 rpm, Gentle agitation 2: in Nauta mixer at a rotation speed of 60 rpm and a revolution speed of 2 rpm (Agitation force: Strong agitation > Gentle agitation 1 > Gentle agitation 2)
**Low: 2.8 to 3.1 Mg/m$^3$, Medium: higher than 3.1 to 3.4 Mg/m$^3$, High: higher than 3.4 to 3.6 Mg/m$^3$

INDUSTRIAL APPLICABILITY

According to the present invention, the raw material powder for powder metallurgy can be efficiently mixed at a low cost with a simple measure and the apparent density of the raw material powder for powder metallurgy can also be adjusted.

The invention claimed is:

1. A method for mixing a raw material powder for powder metallurgy, comprising:

obtaining a powder mixture by adding, to an iron powder:

an alloying powder, a binding agent, and one or more members selected from lubricant powders, free-machining agent powders, and lubricant powders for sliding surface; and performing first agitation mixing on the powder mixture to obtain a resulting powder mixture, the first agitation mixing including:

a first agitation with a first rotation speed while increasing the temperature to a temperature $T_K$ equal to or higher than the melting point $T_M$ of the binding agent;

a second agitation with a second rotation speed while maintaining the temperature $T_K$; and a third agitation with a third rotation speed while reducing the temperature from the temperature $T_K$, wherein an apparent density of the resulting powder mixture is controlled by setting mixing parameters so that either (i) the second rotation speed is relatively stronger than both the first rotation speed and the third rotation speed, or (ii) the second rotation speed is relatively stronger than one of the first rotation speed and the third rotation speed and the second rotation speed is approximately equal to the other of the one of the first rotation speed and the third rotation speed.

2. The method for mixing a raw material powder for powder metallurgy according to claim 1, further comprising performing second agitation mixing upon the resulting powder mixture by agitating while cooling the resulting powder mixture, wherein the first agitation mixing is performed with a first mixer, and the second agitation mixing is performed with a second mixer different from the first mixer.

3. The method for mixing a raw material powder for powder metallurgy according to claim 2, wherein the first mixer is a high-speed agitating mixer.

4. The method for mixing a raw material powder for powder metallurgy according to claim 3, wherein a duration of the first agitation mixing and a duration of the second agitation mixing are equal to each other.

5. The method for mixing the raw material powder for powder metallurgy according to claim 3, wherein one or more members selected from lubricant powders, flow enhancing agents, free-machining agent powders, and lubricant powders for sliding surface are added to the raw material powder during the second agitation mixing.

6. The method for mixing a raw material powder for powder metallurgy according to claim 2, wherein a duration of the first agitation mixing and a duration of the second agitation mixing are equal to each other.

7. A method for adjusting the apparent density of a raw material powder for powder metallurgy, comprising mixing the iron powder, the alloying powder, the binding agent, and one or more members selected from the lubricant powders, the free-machining agent powders, and the lubricant powders for sliding surface in accordance with the mixing method according to claim 6.

8. The method for mixing the raw material powder for powder metallurgy according to claim 2, wherein one or more members selected from lubricant powders, flow enhancing agents, free-machining agent powders, and lubricant powders for sliding surface are added to the raw material powder during the second agitation mixing.

9. A method for adjusting the apparent density of a raw material powder for powder metallurgy, comprising mixing the iron powder, the alloying powder, the binding agent, and one or more members selected from the lubricant powders, the free-machining agent powders, and the lubricant powders for sliding surface in accordance with the mixing method according to claim 2.

10. The method for mixing a raw material powder for powder metallurgy according to claim 2, wherein, in the first agitation mixing, the first rotation speed is approximately equal to the third rotation speed.

11. The method for mixing a raw material powder for powder metallurgy according to claim 10, wherein a duration of the first agitation mixing and a duration of the second agitation mixing are equal to each other.

12. A method for adjusting the apparent density of a raw material powder for powder metallurgy, comprising mixing the iron powder, the alloying powder, the binding agent, and one or more members selected from the lubricant powders, the free-machining agent powders, and the lubricant powders for sliding surface in accordance with the mixing method according to claim 11.

13. The method for mixing the raw material powder for powder metallurgy according to claim 10, wherein one or more members selected from lubricant powders, flow enhancing agents, free-machining agent powders, and lubricant powders for sliding surface are added to the raw material powder during the second agitation mixing.

14. A method for adjusting the apparent density of a raw material powder for powder metallurgy, comprising mixing the iron powder, the alloying powder, the binding agent, and one or more members selected from the lubricant powders, the free-machining agent powders, and the lubricant powders for sliding surface in accordance with the mixing method according to claim 10.

15. The method for mixing a raw material powder for powder metallurgy according to claim 1, wherein, in the first agitation mixing, the first rotation speed is approximately equal to the third rotation speed.

16. A method for adjusting the apparent density of a raw material powder for powder metallurgy, comprising mixing the iron powder, the alloying powder, the binding agent, and one or more members selected from the lubricant powders, the free-machining agent powders, and the lubricant powders for sliding surface in accordance with the mixing method according to claim 15.

17. A method for adjusting the apparent density of a raw material powder for powder metallurgy, comprising mixing the iron powder, the alloying powder, the binding agent, and one or more members selected from the lubricant powders, the free-machining agent powders, and the lubricant powders for sliding surface in accordance with the mixing method according to claim 1.

18. A method for mixing raw material powder for powder metallurgy, comprising:

(a) obtaining a first powder mixture by adding, to an iron powder:

an alloying powder, a binding agent, and one or more members selected from lubricant powders, free-machining agent powders, and lubricant powders for sliding surface;

(b) performing first agitation mixing on the first powder mixture to obtain a first resulting powder mixture with a first apparent density, the first agitation mixing including:

a first agitation with a first rotation speed while increasing the temperature to a temperature $T_K$ equal to or higher than the melting point $T_M$ of the binding agent;

a second agitation with a second rotation speed while maintaining the temperature $T_K$; and a third agitation with a third rotation speed while reducing the temperature from the temperature $T_K$, wherein the first agitation mixing parameters are set so that (i) the second rotation speed is relatively stronger than both the first rotation speed and the third rotation speed, (ii) the second rotation seed is approximately equal to both the first rotation speed and the third rotation speed, or (iii) the second rotation speed is relatively stronger than one of the first rotation speed and the third rotation speed and the second rotation speed is approximately equal to the other of the one of the first rotation speed and the third rotation speed;

(c) obtaining a second powder mixture by adding to an iron powder:

the alloying powder, the binding agent, and one or more members selected from the lubricant powders, the free-machining agent powders, and the lubricant powders for sliding surface; and (d) performing second agitation mixing on the second powder mixture to obtain a second resulting powder mixture with a second apparent density, the second agitation mixing including:

a fourth agitation with a fourth rotation speed while increasing the temperature to a temperature $T_K$ equal to or higher than the melting point $T_M$ of the binding agent;

a fifth agitation with a fifth rotation speed while maintaining the temperature $T_K$: and a sixth agitation with a sixth rotation speed while reducing the temperature from the temperature $T_K$, wherein the second agitation mixing parameters are set so that (iv) the fifth rotation speed is relatively stronger than both the fourth rotation speed and the sixth rotation speed, (v) the fifth rotation speed is approximately equal to both the fourth rotation speed and the sixth rotation speed, or (vi) the fifth rotation speed is relatively stronger than one of the fourth rotation speed and the sixth rotation speed and the fifth rotation speed is approximately equal to the other of the one of the fourth rotation speed and the sixth rotation speed, and wherein the second apparent density is controlled to be different from the first apparent density by selecting the second agitation mixing parameters to be different from the first agitation mixing parameters.

* * * * *